US006427841B2

(12) United States Patent
Wani et al.

(10) Patent No.: US 6,427,841 B2
(45) **Date of Patent: *Aug. 6, 2002**

(54) BATTERY PACKAGE

(75) Inventors: Yoshiaki Wani, Saitama; Masatsugu Shiota, Fukushima; Toru Ichikawa, Tokyo, all of (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/532,783

(22) Filed: Mar. 22, 2000

(30) Foreign Application Priority Data

Mar. 29, 1999 (JP) ..... 11-086782

(51) Int. Cl.[7] ..... B65D 85/20; B65D 73/02
(52) U.S. Cl. ..... 206/705; 206/471; 206/806
(58) Field of Search ..... 206/703, 705, 206/461, 462, 467, 471, 486, 487, 476, 490, 806, 532

(56) References Cited

U.S. PATENT DOCUMENTS

| | | | | | |
|---|---|---|---|---|---|
| 2,952,353 | A | * | 9/1960 | Rohdin | 206/419 |
| 4,011,949 | A | * | 3/1977 | Braber et al. | 206/532 |
| 4,159,771 | A | * | 7/1979 | Komatsu et al. | 206/532 |
| 4,723,656 | A | * | 2/1988 | Kiernan et al. | 206/705 |
| 4,958,731 | A | * | 9/1990 | Calcerano | 206/705 |
| 5,188,231 | A | * | 2/1993 | Kivell et al. | 206/705 |
| 5,311,989 | A | * | 5/1994 | Ward et al. | 206/705 |
| 5,325,968 | A | * | 7/1994 | Sowden | 206/532 |
| 5,390,792 | A | | 2/1995 | Van Ness et al. | |
| 5,429,233 | A | * | 7/1995 | Juaristi | 206/705 |
| 5,560,490 | A | * | 10/1996 | Chawla | 206/471 |
| 5,735,404 | A | * | 4/1998 | Kumakura et al. | 206/705 |
| 5,820,904 | A | * | 10/1998 | Mello et al. | 206/471 |
| 5,899,333 | A | * | 5/1999 | Williams et al. | 206/705 |

FOREIGN PATENT DOCUMENTS

| | | |
|---|---|---|
| EP | 0844193 | 5/1998 |
| FR | 2491885 | 4/1982 |
| GB | 2163130 | 2/1986 |

* cited by examiner

*Primary Examiner*—Luan K. Bui
(74) *Attorney, Agent, or Firm*—Sonnenschein, Nath & Rosenthal

(57) ABSTRACT

A battery package is disclosed which permits only required batteries of a plurality of accommodated batteries to be removed and which can be used as a container after the battery package has been opened. The battery package incorporates a cover having a plurality of battery accommodating portions which are opened in either principal plane of the cover, each of which accommodates each battery and which are integrally formed with the cover such that the battery accommodating portions project inwards; and a mount bonded to the principal plane of the cover to seal openings of the battery accommodating portions, wherein each battery accommodating portion has a battery holding portion formed at a position more adjacent to the opening as compared with the center of the accommodated battery and structured to reduce the inner diameter of the battery accommodating portion as compared with the outer diameter of the battery.

6 Claims, 3 Drawing Sheets

BATTERY PACKAGE

RELATED APPLICATION DATA

The present application claims priority to Japanese Application No. P11-086782 filed Mar. 29, 1999 which application is incorporated herein by reference to the extent permitted by law.

BACKGROUND OF THE INVENTION

1. Field of the Invention

The present invention relates to a battery package for accommodating a plurality of batteries which are displayed for sale.

2. Description of the Related Art

Hitherto, a plurality of batteries are collectively soled in units such that the plural batteries are collectively accommodated in one battery package so as to be displayed and exhibited. As a battery package of the foregoing type, a so-called "blister pack" is known which incorporates a cover in the form of a sheet made of synthetic resin; and a mount constituted by a cardboard or a synthetic-resin film.

The conventional blister pack incorporates the cover having one recess which constitutes a battery accommodating portion and which is formed by heat molding or the like such that the recess projects to the reverse side. Thus, a plurality of batteries are collectively accommodated in the recess. The blister pack incorporates the mount which seals the opening of the battery accommodating portion provided for the cover to hold the accommodated batteries so as to prevent separation of the batteries.

The blister pack has a structure that an adhesive agent or a heat-sensitive film to which heat or pressure is applied is used to bond the cover and the mount to each other to seal the battery accommodating portion. Therefore, the mount of the conventional blister pack bonded to the cover is separated when the blister pack is opened to remove the batteries.

As described above, the conventional blister pack has the structure that a plurality of batteries are collectively accommodated in one battery accommodating portion. Therefore, all of the batteries are, however, removed from the battery accommodating portion when the blister pack is once opened regardless of the number of required batteries. It leads to a fact that the conventional blister pack does not permit the removed and non-used batteries and used batteries to easily be distinguished from one another. Thus, there is apprehension that the non-used batteries and used batteries are undesirably mixed with one another. When the non-used batteries and the used batteries are mixed with one another, there arises a problem in that a used battery is used or a non-used battery is abandoned.

Moreover, the conventional blister pack which has been opened is brought to a state where the mount for sealing the opening of the battery accommodating portion has been separated. Therefore, the batteries cannot again be accommodated and held. Therefore, the conventional blister pack cannot serve as the accommodating container after it has been opened. Hence it follows that the conventional blister pack cannot conveniently be used because it can be used to only accommodate batteries before the blister pack is opened.

SUMMARY OF THE INVENTION

Accordingly, an object of the present invention is to provide a battery package which permits only required batteries of a plurality of accommodated batteries to be removed and which can continuously be used as a container for accommodating batteries.

To achieve the object, according to one aspect of the present invention, there is provided a battery package comprising: a cover having a plurality of battery accommodating portions which are opened in either principal plane of the cover, each of which accommodates each battery and which are integrally formed with the cover such that the battery accommodating portions project inwards; and a mount bonded to the principal plane of the cover to seal openings of the battery accommodating portions, wherein each battery accommodating portion has a battery holding portion formed at a position more adjacent to the opening as compared with the center of the accommodated battery and structured to reduce the inner diameter of the battery accommodating portion as compared with the outer diameter of the battery.

The battery package according to the present invention has the foregoing structure. Therefore, each battery is accommodated and held in each of the plural battery accommodating portions each having a portion which is formed adjacent to the opening of the battery accommodating portion and with which the inner diameter of the battery accommodating portion is made to be smaller than the outer diameter of the battery which must be accommodated. Therefore, the battery package according to the present invention permits only required batteries to be removed, while the other batteries which are not used are being as it is accommodated and held in the battery accommodating portions. Moreover, used batteries can again be accommodated in the battery accommodating portions.

Other objects, features and advantages of the invention will be evident from the following detailed description of the preferred embodiments described in conjunction with the attached drawings.

DETAILED DESCRIPTION OF THE PREFERRED EMBODIMENTS

Embodiments of a battery package according to the present invention will now be described with reference to the drawings. The battery package according to this embodiment is a blister pack 1 structured to be capable of accommodating two cylindrical batteries.

Figure 1:
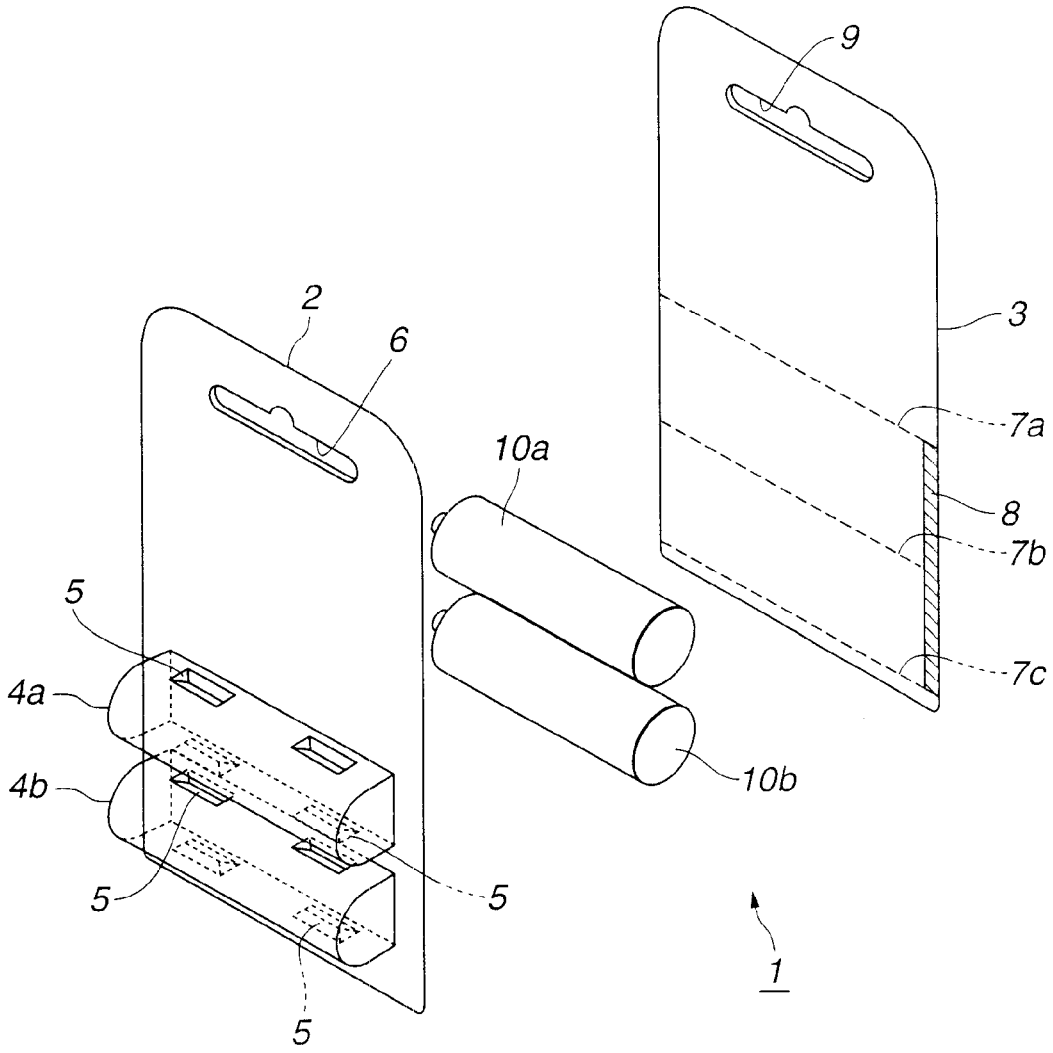
FIG. 1 is an exploded perspective view of a blister pack structured to be capable of accommodating two cylindrical batteries.

As shown in FIG. 1, the blister pack 1 incorporates a blister cover 2; and a mount 3 which is bonded to either principal plane (hereinafter simply called as a "rear surface") of the blister cover 2. The blister pack 1 accommodates two cylindrical batteries 10*a* and 10*b* (hereinafter collectively called a "cylindrical battery 10" except for a case where each of the cylindrical batteries 10*a* and 10*b* must be described). The cylindrical batteries 10*a* and 10*b* are displayed so as to be sold as one pair.

Figure 2:
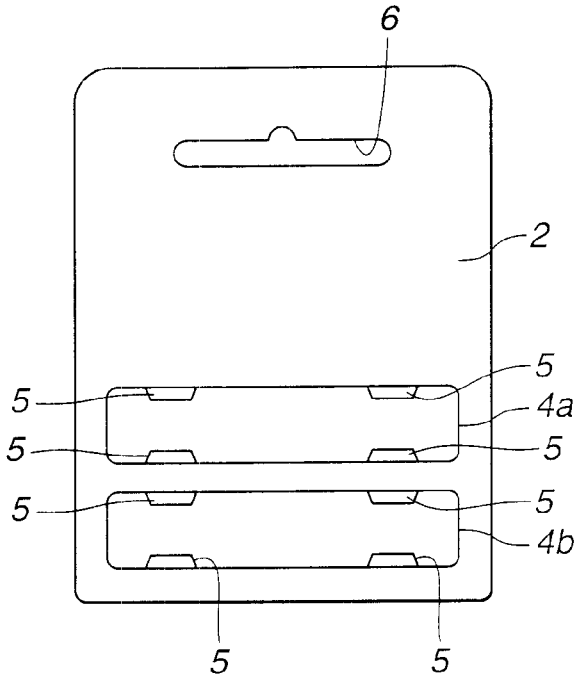
FIG. 2 is a further view of the blister cover.

The blister cover 2 is constituted by synthetic resin, such as polyethylene terephthalate (PET). As shown in FIGS. 1 and 2, the blister cover 2 has battery accommodating portions 4*a* and 4*b* (hereinafter collectively called a "battery accommodating portion 4" except for a case where each of the battery accommodating portions 4*a* and 4*b* must be described). The battery accommodating portions 4 are formed in the portions adjacent to a lengthwise end of a transparent PET sheet formed into substantially a rectangular shape. The battery accommodating portions 4 are formed integrally with the blister cover 2 such that the battery accommodating portions 4 project outwards.

Figure 3:
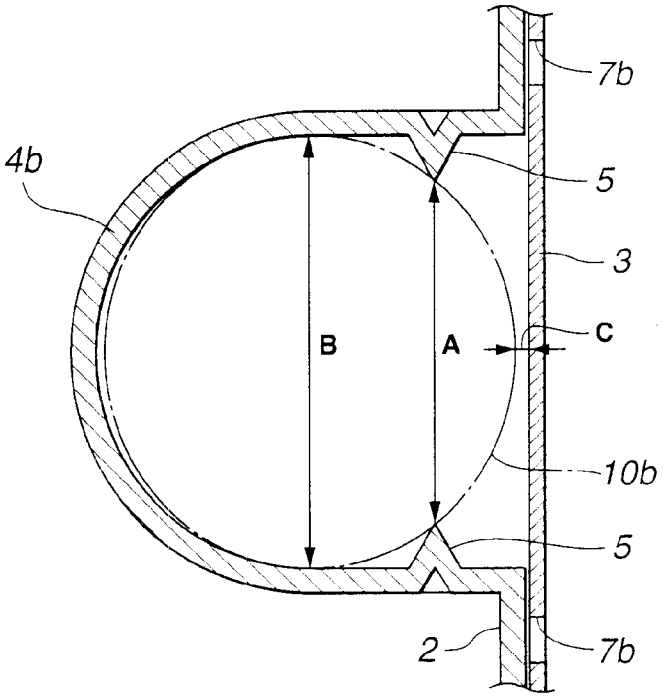
FIG. 3 is a vertical cross sectional view of an essential portion of the blister pack.

As shown in FIGS. 1 and 3, each of the battery accommodating portions 4 is a recess opened in the rear surface of the blister cover 2. The inner diameter of each of the battery accommodating portions 4 is substantially the same as the diameter B of the cylindrical battery 10 which must be accommodated. The surface of the battery accommodating portions 4, which is the projecting principal plane (hereinafter simply called a "surface") of the blister cover 2, is formed into a barrel shape having a circular-arc shape cross section to conform to the shape of the cylindrical battery 10 which must be accommodated. The battery accommodating portions 4*a* and 4*b* are independently formed apart from each other for a predetermined distance, the battery accommodating portions 4*a* and 4*b* being formed in parallel with the widthwise direction of the blister cover 2.

The battery accommodating portions 4 has two pairs of projections 5, that is, four projections 5 formed adjacent to the ends of the openings of the blister cover 2 at positions opposite to each other. The distance A between the projections 5 is shorter than the diameter B of the cylindrical battery 10. The leading end of the projection 5 is formed to be brought into contact with the outer surface of the accommodated cylindrical battery 10.

As shown in FIG. 3, the battery accommodating portion 4 incorporates the projections 5 formed more adjacent to the ends of the opening as compared with the center of the cylindrical battery 10 which must be accommodated. The projections 5 reduce a portion of the inner diameter of the battery accommodating portion 4 to be smaller than the diameter B of the blister pack 1. The leading ends of the projections 5 are brought into contact with the cylindrical battery 10. Thus, the accommodated cylindrical battery 10 is held such that the cylindrical battery 10 is pressed against the surface of the battery accommodating portion 4. Therefore, the cylindrical battery 10 accommodated in the battery accommodating portion 4 cannot easily be separated even if the opening is not sealed by the mount 3, that is, if the blister pack 1 is opened. Since the cylindrical battery 10 is pressed and held along the surface of the battery accommodating portion 4 of the blister pack 1, rotation of the cylindrical battery 10 accommodated in the battery accommodating portion 4 such that the type and manufacturer can be confirmed can be prevented. The number of the projections 5 which are formed in the battery accommodating portions 4 of the blister pack 1 is not limited.

The depth of the recessed battery accommodating portion 4 formed in the blister cover 2 is made to be somewhat larger than the diameter B of the cylindrical battery 10. Therefore, a clearance C is created between the cylindrical battery 10 and the mount 3 after the mount 3 has been bonded to the blister cover 2 as described later. Thus, no load is exerted from the cylindrical battery 10 accommodated in the battery accommodating portion 4 on the mount 3. Hence it follows that the separation of the mount 3 occurring during, for example, transport can be prevented.

The battery accommodating portions 4 and the projections 5 of the blister cover 2 are formed by vacuum molding a flat and rectangular PET sheet.

The blister cover 2 has a hanger hole 6 formed adjacent to the lengthwise-directional end of the blister cover 2, that is, adjacent to the end portion in which the battery accommodating portions 4 are not formed. The hanger hole 6 of the blister cover 2 is formed to permit penetration of a pin or the like when the blister pack 1 is hung and displayed at the storefront.

The mount 3 is bonded to the rear surface of the blister cover 2 to seal the battery accommodating portions 4. The mount 3 is constituted by a cardboard or synthetic-resin film made of PET or the like formed into substantially the same shape as the projected plane of the blister cover 2.

As shown in FIG. 1, the mount 3 has three perforations which are in parallel with each other in the widthwise direction of the mount 3. That is, a first perforations 7*a*, a second perforations 7*b* and a third perforations 7*c* (hereinafter collectively called "perforations 7" except for a case where each of the perforations 7*a*, 7*b* and 7*c* must be described) are provided for the mount 3. The first perforations 7*a*, the second perforations 7*b* and the third perforations 7*c* are formed such that the battery accommodating portion 4*a* and the battery accommodating portion 4*b* are located among the three perforations 7*a*, 7*b* and 7*c*. Note that the blister pack 1 must be structured such that the second perforations 7*b* are located between the battery accommodating portion 4*a* and the battery accommodating portion 4*b*.

Either principal plane of the mount 3 serves as a surface which must be bonded to the rear surface of the blister cover 2. The principal plane is coated with a hot-melt adhesive agent. The principal plane of the mount 3 which must be bonded to the blister cover 2 may be laminated with a heat-sensitive film. As an alternative to this, another process for enabling bonding of the mount 3 to the blister cover 2 may be employed.

A non-fusible portion 8 is formed between the first perforations 7*a* and the third perforations 7*c* of the mount 3, the non-fusible portion 8 being located adjacent to either side end of the mount 3. The non-fusible portion 8 is not subjected to the process for applying the hot-melt adhesive agent or the laminating process using the heat-sensitive film. The non-fusible portion 8 serves as a portion for permitting start of separation of the mount 3 from the blister cover 2.

The mount 3 has a hanger hole 9 at a position corresponding to the hanger hole 6 formed in the blister cover 2. The hanger hole 9 of the mount 3 is formed to permit penetration of a pin or the like when the blister pack 1 is hung and displayed at the storefront.

The rear flat portion of the blister cover 2 of the blister pack 1 and the bonding surface of the mount 3 are laminated to be opposite to each other. Then, heat or pressure is applied through the mount 3 so that the blister cover 2 and the mount 3 are bonded to each other.

Figure 4:
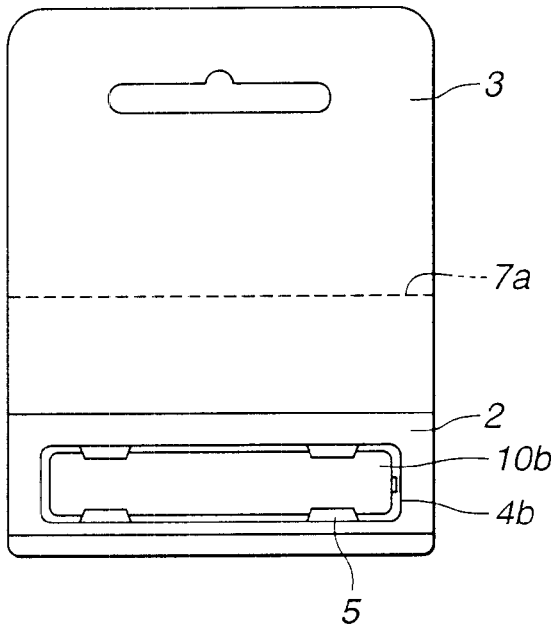
FIG. 4 is a rear view of the blister pack in a state in which a portion of a mount has been separated.

The blister pack 1 having the above-mentioned structure permits removal of only required cylindrical batteries 10 of the two accommodated cylindrical batteries 10. When only cylindrical battery 10*b* is removed from the blister pack 1, the non-fusible portion 8 formed between the second perforations 7*b* and the third perforations 7*c* is pulled. Thus, only the mount 3 between the second perforations 7*b* and the third perforations 7*c* is separated from the blister cover 2. Therefore, only the battery accommodating portion 4*b* is opened, as shown in FIG. 4. Then, pressure is applied from the right side toward the rear side of the blister pack 1, the cylindrical battery 10*b* is separated from the projections 5. Thus, the cylindrical battery 10*b* is removed from the battery accommodating portion 4*b*. Since the battery accommodating portion 4*a* is not opened, the blister pack 1 is able to easily preserve the non-used battery 10.

The used cylindrical battery 10*b* is inwards pushed from the opening formed in the reverse side toward the right side so that the cylindrical battery 10*b* is held by the projections 5. Thus, separation of the cylindrical battery 10*b* can be prevented and re-accommodation of the same in the battery accommodating portion 4*b* is permitted. As described above, the blister pack 1 can be used as a container for accommodating used batteries even after the battery accommodating portion 4 has been opened. When the used cylindrical battery 10*b* is accommodated in the blister pack 1, the used battery and the non-used battery can easily be distinguished from each other in accordance with presence of the mount 3, that is, whether or not the battery accommodating portion 4 has been opened. Therefore, the blister pack 1 is able to prevent unintentional use of the used battery or discard of a non-used battery caused from mixture of the non-used battery and the used battery.

Figure 5:
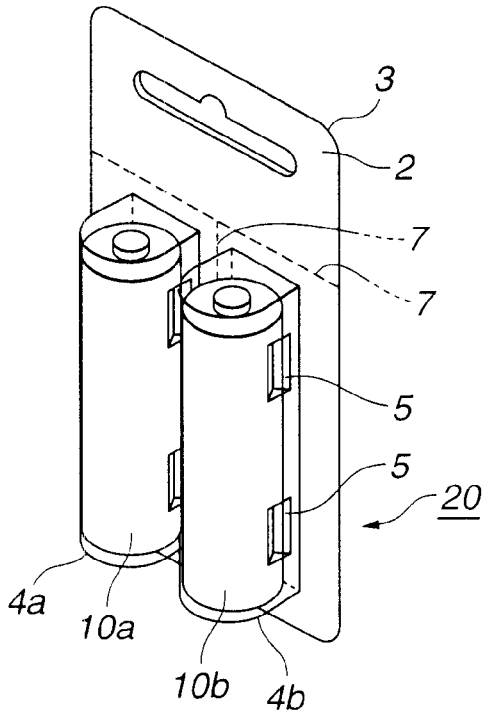
FIG. 5 is a perspective view of another embodiment of the blister pack structured to be capable of accommodating two cylindrical batteries.

As described above, the blister pack 1 according to the embodiment has the structure that the two cylindrical batteries 10 are arranged in parallel with each other in the widthwise direction of the blister pack 1 so as to be accommodated. As a matter of course, the battery package according to the present invention is not limited to the above-mentioned structure. The battery package may be structured to accommodate three or more batteries. A blister pack 20 shown in FIG. 5 may be employed, the blister pack 20 being structured to arrange two cylindrical batteries 10 in parallel with each other in the lengthwise direction to accommodate the two cylindrical batteries 10. The blister pack 20 is structured and used similarly to the blister pack 1 except for T-shaped perforations 7.

Each of the blister pack 1 and the blister pack 20 incorporates the perforations 7. Another structure may be employed which is formed such that the overall portion of the mount 3 is separated as a substitute for forming the perforations 7. Also in the foregoing case, a plurality of the battery accommodating portions 4 are independently formed to correspond to the batteries which must be accommodated. Therefore, only required batteries can be removed. The battery which is not used is held in the battery accommodating portion 4 without a fear of separation thanks to the projections 5. As a result, the battery package according to the present invention can be used as a container for accommodating the batteries.

The battery package according to the present invention has the above-mentioned structure. Thus, each battery is accommodated and held in each of the plural battery accommodating portions each of which has the shape structured such that the portion adjacent to the opening is narrowed as compared with the outer diameter of the battery. Hence it follows that only a required battery can be removed and a battery which is not used is as it is accommodated and held in the battery accommodating portion. Moreover, the battery package according to the present invention permits a non-used battery to again be accommodated in the battery accommodating portion. In addition, the battery package can be used as a container even after the battery package has been opened.

Although the invention has been described in its preferred form and structure with a certain degree of particularity, it is understood that the present disclosure of the preferred form can be changed in the details of construction and in the combination and arrangement of parts without departing from the spirit and the scope of the invention as hereinafter claimed.

What is claimed is:

1. A battery package comprising:

a cover having a plurality of battery accommodating portions for accommodating a corresponding plurality of batteries, each battery having an outer diameter, wherein each of said battery accommodating portions has an inner diameter and an opening in a principal plane of said cover, and wherein said battery accommodating portions are integrally formed with said cover such that said battery accommodating portions project inwards; and a mount bonded to said cover at the principal plane of said cover to seal said openings of said battery accommodating portions, said mount comprising an unexposed non-fusible portion corresponding to each of said battery accommodating portions, for assisting in separation of said mount from said battery accommodating portions, wherein said non-fusible portion is located adjacent to said opening, wherein each battery accommodating portion has one or more battery holding portions formed at a position substantially adjacent to said openings and structured to reduce the inner diameter of said battery accommodating portions as compared with the outer diameter of said batteries, and said mount and said cover have holes having substantially the same shapes.

2. A battery package according to claim 1, wherein said battery holding portions are projections each of which is formed substantially adjacent to said openings of said battery accommodating portions, and which project inwards.

3. A battery package according to claim 1, wherein said mount has perforations formed at least among said plural battery accommodating portions.

4. A battery package comprising:

a cover having a plurality of battery accommodating portions for accommodating a corresponding plurality of batteries, each battery having an outer diameter, wherein each of said battery accommodating portions has an inner diameter and an opening in a principal plane of said cover, and wherein said battery accommodating portions are integrally formed with said cover such that said battery accommodating portions project inwards; and a mount bonded to said cover at the principal plane of said cover to seal said openings of said battery accommodating portions, said mount comprising an unexposed non-fusible portion corresponding to each of said battery accommodating portions, for assisting in separation of said mount from said battery accommodating portions, wherein said non-fusible portion is located adjacent to said opening and along an outside edge of the package, wherein each battery accommodating portion is formed to create a fixed space between said mount and said corresponding battery when said corresponding battery has been accommodated, such that said fixed space spans a distance which does not vary and said mount and said cover have holes having substantially the same shape.

5. A battery package according to claim 4, wherein each battery accommodating portion has one or more battery holding portions formed at a position substantially adjacent to said openings and structured to reduce the inner diameter of said battery accommodating portions as compared with the outer diameter of said batteries.

6. A battery package according to claim 4, wherein said mount has perforations formed at least among said plural battery accommodating portions.

* * * * *